US011823559B2

(12) United States Patent
Johnson et al.

(10) Patent No.: US 11,823,559 B2
(45) Date of Patent: Nov. 21, 2023

(54) METHOD AND SYSTEM TO PROJECT GUIDANCE TO BUILDING OCCUPANTS DURING AN EMERGENCY SITUATION

(71) Applicant: MOTOROLA SOLUTIONS, INC., Chicago, IL (US)

(72) Inventors: Eric Johnson, Chicago, IL (US); Benjamin Zaslow, Chicago, IL (US); Youngeun Olivia Kang, Chicago, IL (US); Yanling Xu, Somerville, MA (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 358 days.

(21) Appl. No.: 16/714,996

(22) Filed: Dec. 16, 2019

(65) Prior Publication Data

US 2021/0183218 A1 Jun. 17, 2021

(51) Int. Cl.
*G08B 25/00* (2006.01)
*G08B 7/06* (2006.01)
(Continued)

(52) U.S. Cl.
CPC ..... *G08B 7/066* (2013.01); *G08B 13/22* (2013.01); *G08B 21/10* (2013.01); *G08B 21/12* (2013.01); *G09G 3/002* (2013.01)

(58) Field of Classification Search
CPC ..... H04W 4/90; H04W 4/021; H04W 4/023; H04W 4/026; H04W 4/38; H04W 4/80; H04W 12/06; H04W 84/18; H04W 48/20; H04W 52/0219; H04W 56/00; H04W 4/00; H04W 4/025; H04W 4/029; H04W 4/06; H04W 4/14; H04W 52/0229; H04W 52/0254; H04W 64/00; H04W 76/50; H04W 84/12; G08B 25/10; G08B 27/00; G08B 21/18; G08B 5/222; G08B 25/016; G08B 17/10; G08B 25/001; G08B 25/14; G08B 21/0241; G08B 21/12;
(Continued)

(56) References Cited

U.S. PATENT DOCUMENTS 5,117,221 A 5/1992 Mishica, Jr.
6,150,943 A * 11/2000 Lehman ..... G08B 7/062 340/332
(Continued)

OTHER PUBLICATIONS

MadMapper the Mapping Software, Version 3.7 MAC & Windows, https://madmapper.com, downloaded from the internet: Nov. 13, 2019, all pages.
(Continued)

*Primary Examiner* — Daniel Previl

(57) ABSTRACT

A method and system provide for project a safe area during an emergency situation is provided. A server, using at least one electronic sensor, determines that an emergency situation is occurring in a building. The emergency situation can be an armed intruder, a natural disaster, a chemical spill or the like, etc. The server determines likely unsafe areas and at least one likely safe area within the building during the emergency situation. A projector, which can be incorporated into a camera or separate from a camera, projects visual guidance features within the building, the visual guidance features directing occupants in the building toward the likely safe area.

18 Claims, 6 Drawing Sheets

(51) Int. Cl.

| | |
|---|---|
| ***G09G 3/00*** | (2006.01) |
| ***G08B 13/22*** | (2006.01) |
| ***G08B 21/10*** | (2006.01) |
| ***G08B 21/12*** | (2006.01) |

(58) Field of Classification Search

CPC ..... G08B 29/188; G08B 7/066; G08B 13/22; G08B 17/06; G08B 21/02; G08B 21/043; G08B 21/0453; G08B 21/10; G08B 25/00; G08B 25/006; G08B 25/08; G08B 25/12; G08B 27/003; G01C 21/20; G01C 21/34; G01C 21/362; G01C 21/32; G01C 21/3697; G01C 21/30; G06Q 10/1095; G06Q 10/109; G06Q 50/10; G06Q 50/26; G06Q 10/06; G06Q 10/06316; G06Q 10/06398; A61B 5/7264; A61B 5/0015; A61B 5/14503; A61B 5/14532; A61B 5/4839; A61B 2503/04; A61B 5/0004; A61B 5/14552; A61B 5/6802; A61B 5/6807; A61B 5/6898; A61B 5/746; A61B 18/08; A61B 18/1402; A61B 18/201; A61B 18/203; A61B 2017/00084; A61B 2017/0046; A61B 2017/00761; A61B 2017/00792; A61B 2017/00853; A61B 2018/00017; A61B 2018/00452; A61B 2018/1807; A61B 2018/2272; A61B 2007/0008; A61M 2005/14208; A61M 2205/502; A61M 2205/581; A61M 5/142; A61M 5/14244; A61M 5/20; G06F 19/3418; G06F 19/3468; G06F 19/3481; G06F 21/10; G06F 3/013; G06N 20/00; G06N 5/048; G06N 5/04; G06N 5/045; G16H 20/17; G16H 20/60; G16H 40/63; G16H 50/20; G16H 50/70; Y02A 90/26; Y02A 50/14; Y02D 70/00; Y02D 70/142; Y02D 70/144; Y02D 70/164; Y02D 70/26; Y02D 70/1224; Y02D 70/1226; Y02D 70/1242; Y02D 70/146; Y02D 70/162; Y02D 70/166; Y02D 70/22; Y02D 70/10; Y02D 70/20; A62C 37/50; B66B 5/022; B66B 1/2408; B66B 1/3461; B66B 1/468; B66B 2201/103; B66B 2201/4615; B66B 2201/4653; F41C 33/029; G05B 15/02; G05B 2219/2642; G05B 23/0224; G05B 23/0286; H02J 2310/14; H04N 7/185; H04N 21/4126; H04N 21/42204; H04N 21/42661; H04N 21/4312; H04N 21/4314; H04N 21/4316; H04N 21/443; H04N 21/4622; H04N 21/47; H04N 21/482; H04N 21/6125; H04N 5/772; H04N 7/17318; H04N 7/188; Y02B 70/3266; Y04S 20/242; B60R 22/321; B60T 2230/06; B60T 8/323; B64C 2201/122; B64C 39/024; B66F 3/08; B66F 3/46; E02D 27/32; E04H 9/145; E05B 51/023; E05B 77/12; F21K 9/23; F21K 9/233; F21K 9/27; F21V 23/005; F21V 23/0435; F21V 33/0052; F21Y 2115/10; F41J 9/18; G01D 21/02; B60W 30/09; B60W 50/12; B60W 30/0956; B60W 30/18154; B60W 2050/143; B60W 2554/40; B60W 40/04; B60W 50/14; B60W 2552/05; B60W 2552/53; B60W 2554/00; B60W 2555/20; B60W 2555/60; B60W 2556/40; B60W 270/182; B60W 30/146; B60W 30/162; B60W 30/18163; B60W 40/06; B60W 50/10; G06K 9/00798; G06K 9/00818; G06K 9/00825; G06K 9/00805; G06K 9/00845; G06K 9/00791; G06K 9/6289; A61N 2007/0008; A61N 7/02; G09G 3/002; H04K 2203/24; H04K 2203/32; H04K 3/43; H04K 3/44; H04K 3/62; H04K 3/92; B27G 13/08; B27L 11/005; B63G 13/00; B63G 13/02; G08G 1/166; G08G 1/167

USPC ..... 340/541, 3.1, 628, 332, 691.1, 331, 326, 340/815.57, 815.4, 517

See application file for complete search history.

(56) References Cited

U.S. PATENT DOCUMENTS

| | | | | |
|---|---|---|---|---|
| 7,440,620 | B1 | 10/2008 | Aartsen | |
| 7,579,945 | B1 | 8/2009 | Richter et al. | |
| 8,809,787 | B2 | 8/2014 | Tidhar | |
| 9,691,245 | B2 * | 6/2017 | Jones, Jr. | G08B 19/005 |
| 9,942,414 | B2 * | 4/2018 | Miwa | G08B 25/006 |
| 2009/0018875 | A1 * | 1/2009 | Monatesti | G06Q 10/06316 705/7.26 |
| 2011/0298579 | A1 * | 12/2011 | Hardegger | G01S 17/10 340/3.1 |
| 2016/0232774 | A1 | 8/2016 | Noland et al. | |
| 2017/0026118 | A1 | 1/2017 | Pederson | |
| 2018/0053394 | A1 * | 2/2018 | Gersten | H04N 9/8205 |
| 2018/0095607 | A1 * | 4/2018 | Proctor | G09F 19/18 |
| 2019/0266881 | A1 * | 8/2019 | Vonfrolio | H04W 4/90 |

OTHER PUBLICATIONS

Unity—Manual Version 2019.2: Occlusion Culling: https://docs.unity3d.com/Manual/OcclusionCulling.html, downloaded from the internet: Nov. 13, 2019, all pages.

* cited by examiner

METHOD AND SYSTEM TO PROJECT GUIDANCE TO BUILDING OCCUPANTS DURING AN EMERGENCY SITUATION

BACKGROUND OF THE INVENTION

Active shooter situations have occurred in school buildings, university campuses, public events, and businesses. These active shooter situations come with a great amount of confusion and chaos.

Students, staff and employees are often taught to remember the Run, Hide, Fight protocol in order to survive such attacks. This protocol suggests that those in a building with an active shooter should first try to run away from the building. If that is unfeasible, they should look for a place to hide within the building. If this is also unfeasible, the last remaining strategy is to fight the attacker, although this is usually dangerous due to the power asymmetry of the participants. In addition, Emergency Action Plans include formalized practices like Evacuation and Lockdown.

One problem with active shooter situations is the chaos and lack of clear and accurate information for the building occupants. Often times it is difficult to tell what direction shots are coming from, which direction to run, where are safe hiding places, etc. In the absence of such critical information, building occupants can stay in place due to the paralyzing effect of high stress and a lack of information.

In addition, natural disasters also can cause confusion and a lack of direction among building occupants. Most buildings have safe areas, but many times the occupant of a building are unfamiliar with them. In addition, natural disasters change over time, and a safe area at one instant may not be safe at a later stage of the disaster.

Therefore, a need exists for a method and system to provide information to people in a building that is currently under an active shooter or natural disaster situation.

BRIEF DESCRIPTION OF THE SEVERAL VIEWS OF THE DRAWINGS

The accompanying figures, where like reference numerals refer to identical or functionally similar elements throughout the separate views, which together with the detailed description below are incorporated in and form part of the specification and serve to further illustrate various embodiments of concepts that include the claimed invention, and to explain various principles and advantages of those embodiments.

Figure 1:
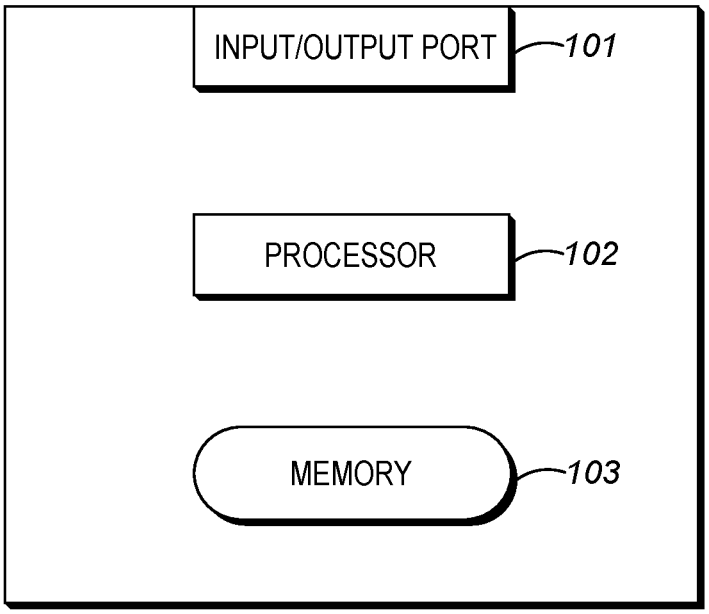
FIG. 1 depicts a schematic of a run/hide/fight server in accordance with an exemplary embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Violent intruder incidents involve an attacker who enters a building with the intention of committing violent acts therein. Natural disaster incidents involve a natural disaster moving toward or descending upon a building. Fires or other incidents, such as sink holes or bee attacks, can occur within buildings and be potentially dangerous for occupants of the building. In addition, buildings that include hazardous chemicals, such as manufacturing facilities or production sites, can have spills or leaks that make the building dangerous to continue to occupy. Still further, gas leaks, carbon monoxide presence, and other dangerous scenarios can make a building dangerous to remain in. In all these emergency situations, detection of a danger and instructions on the best way to move toward a safe area can be very advantageous.

When any of these scenarios occur, the best reaction can vary. For example, if an armed intruder enters a building with the intention to harm people, a building occupant, such as a student, in a different part of the building might be best served by running to the nearest exit. If the armed intruder is near the student or would have a direct view of that occupant running toward an exit, the safest option for the student might be to hide from the attacker. If the attacker has the student cornered, the best option for the student might be to fight the attacker, and having impromptu weapons might save the student's life.

Other scenarios also lend themselves to knowing the right action to take in a dangerous situation. For example, if a natural disaster is heading toward a building, indications of the safest place to be in the building could save lives. And different people in different parts of the building might have different areas to lead toward, which may be closest to their current location. For example, if a tornado is heading toward a building, real-time indications of the best places to hide and find protection from the tornado could provide incredibly valuable to people in the building.

Physical environment data, such as interior and exterior walls, thickness and strength of walls, proximity to windows, can also be used in evaluating the best approach for a building occupant to take during an emergency situation. In certain scenarios, for example explosions, sinkholes, or tornados, the physical environment data can change. In accordance with an exemplary embodiment, any changes to the physical environment data are taken into account when updating the instructions projected for building occupants. In addition, building geometry can also be used in determining the safest places to hide. For example, an occluded area can provide a safe hiding place during a natural disaster or an armed intruder situation.

In addition, an exemplary embodiment adjusts the frequency and precision of computation, for example based on attacker proximity to a building occupant.

All of these scenarios and more are assisted using the system and method described herein.

FIG. 1 depicts a schematic of a run/hide/fight server 100 in accordance with an exemplary embodiment. Run/hide/ fight server 100 is preferably a central server that is connected to a plurality of cameras and projectors located throughout a building. In accordance with a further exemplary embodiment, run/hide/fight server 100 is a plurality of servers that are each attached to a camera and projector to provide control and instructions to the attached camera and projector and are controlled by a main server. Run/hide/fight server 100 preferably includes input/output port 101, processor 102, and memory 103.

Input/output port 101 receives electronic signals from one or more wired or wireless cameras, such as video cameras mounted in a school building. Output port 202 transmits electronic signals to a projector located within a building. Although the above description has input/output port 101 as incorporated in a single element, input/output port 101 can be two separate elements, such as an input port and a separate output port.

Processor 102 triggers methods to minimize interference in converged LMR/LTE communications device 101. Processor 102 may include a microprocessor, application-specific integrated circuit (ASIC), field-programmable gate array, or another suitable electronic device. Processor 102 obtains and provides information, for example, from input/output port 101, memory 103, or to input/output port 101, and processes the information by executing one or more software instructions or modules, capable of being stored, for example, in a random access memory ("RAM") area of memory 103 or a read only memory ("ROM") of memory 103 or another non-transitory computer readable medium (not shown). The software can include firmware, one or more applications, program data, filters, rules, one or more program modules, and other executable instructions. Processor 102 is configured to retrieve from memory 103 and execute, among other things, software related to the control processes and methods described herein.

Memory 103 can include one or more non-transitory computer-readable media, and may include a program storage area and a data storage area. The program storage area and the data storage area can include combinations of different types of memory, as described herein. In the embodiment illustrated, memory 103 stores, among other things, instructions for the processor to carry out the methods of FIG. 2.

In accordance with an exemplary embodiment, memory 103 comprises a database that stores three dimensional building data. The three dimensional building data is preferably obtained from architectural data, but can also be obtained by a site survey using a 3D capture system such as LIDAR (Light Detection and Ranging) or photogrammetry, by surveillance cameras with depth capabilities like dual camera/structured light, or any other suitable means.

Figure 2:
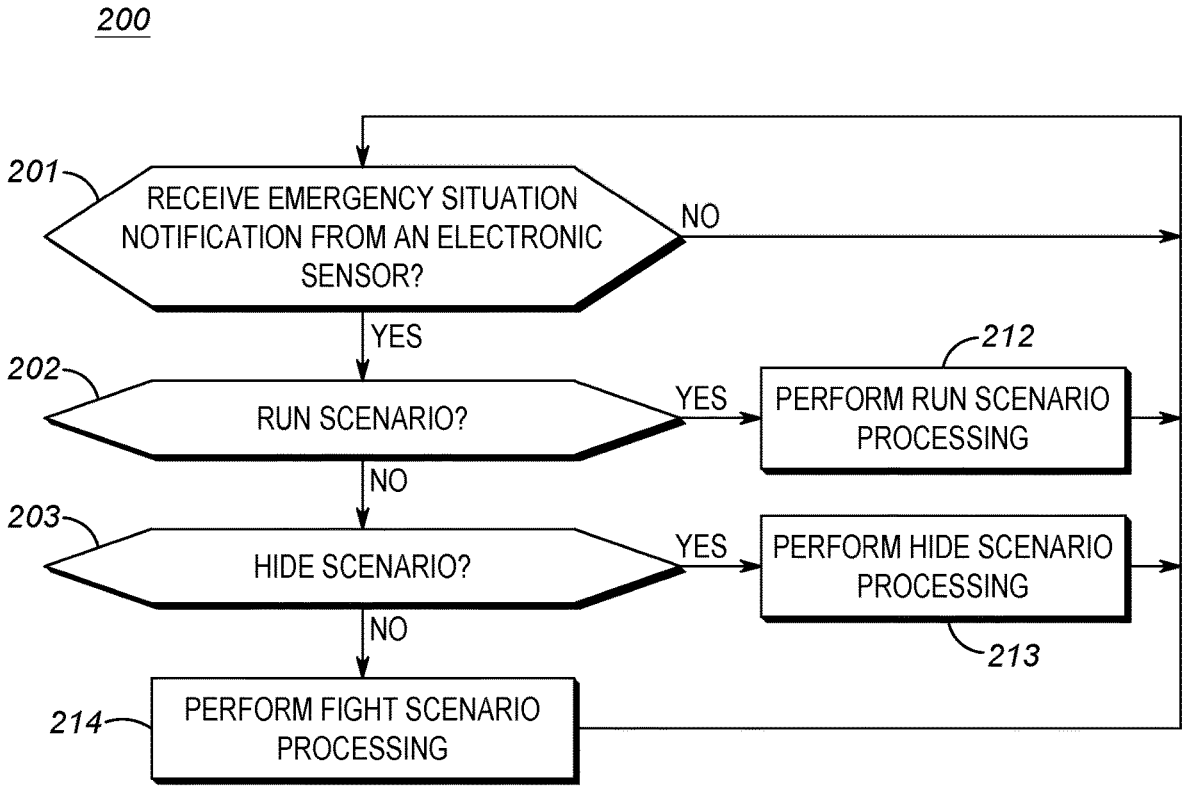
FIG. 2 depicts a flowchart in accordance with an exemplary embodiment.

FIG. 2 depicts a flowchart 200 in accordance with an exemplary embodiment. The steps depicted below are preferably carried out by server 100, for example a server located in the office of building 300.

In accordance with an exemplary embodiment, server 100 determines (M) if it has received an emergency notification from an electronic sensor. The emergency situation notification preferably indicates that an intruder is in building 300 and security precautions should be taken. In an alternate exemplary embodiment, the emergency situation notification indicates that a natural disaster is heading toward building 300. In a further exemplary embodiment, the emergency situation notification indicates that a safety issue has occurred within building 300, such as a fire, chemical leak, or other similar and dangerous situation.

The emergency notification preferably is received from an electronic sensor, such as a video camera located within building 300. The video received from the video camera may include audio that can be analyzed using, for example, analytics software. In an alternate exemplary embodiment, the emergency notification is received from a server located in the central office of building 300, such as a Principal's office or a building management office. The electronic sensor can be, for example, a dedicated and specific sensor for phenomena such as temperature, vibration, pressure, or other conditions that indicate that a dangerous situation may exist. The emergency notification can be triggered automatically or alternately by manual activation by entry into a program located on the server. If no emergency notification is received, the process returns to step 201 and waits a predetermined period of time to determine if an emergency situation notification is received.

In accordance with an exemplary embodiment of an attacker scenario, the physical attributes of the attacker are captured and tracking of the attacker is activated. Examples of physical attributes include but are not limited to appearance, height, equipment, bags, weapons, hair color, and clothing. In addition, the movement and eye gaze are also preferably monitored. The movement may include, for example, the direction of movement, the speed of movement, and the consistency of the movement. Building occupants are preferably also tracked. The tracking of the attacker and building occupants is preferably accomplished via multiple video cameras located throughout building 300.

In accordance with an exemplary embodiment, processor 102 utilizes the physical attributes of the attacker and creates a basic 3D model of the attacker and the potential Field of View (FoV) of the attacker. The FoV may be generalized as a spherical volume or more specifically generated as a cone based on eye gaze. The FoV is preferably positioned in the 3D building model and dynamically updated as the attacker moves in building 300. The attacker's position, historical and predicted movement, and eye gaze are preferably used by processor 102 to determine whether the best approach for any building occupant is the run, hide, or fight. In accordance with an exemplary embodiment, the run, hide, fight calculations are performed and dynamically updated throughout the duration of the incident. As such changes are detected, changes in the preferred instructions to building occupants can also occur. For example, the size and location of safe areas can be modified as the attacker moves within building 300. Further, an area that was originally a "run" area may transition to a "hide" area as the attacker moves closer to the location of a building occupant. The same may be true of a transition from a "hide" area to a "fight" area as an attacker gets very close to a building occupant. It should be understood that changes can also move in the opposite direction, and a hide area can be changed to a run area as the attacker moves away from the hide area or moves to a location within building 300 that does not have a visual lie of sight to the pathway to a safe area.

If it is determined at step 201 that an emergency situation notification has been received, processor 102 determines (202) if this is a scenario where the run scenario is preferred. If it is, processor 102 performs (212) run scenario processing. Run scenario processing is described in more detail in FIG. 3A, but in general the run scenario is chosen when occupants are given the best chance for survival and avoiding injury by running away from attacker 301 or alternately running toward the exits of the building of there is a natural disaster or other dangerous building situation. In an exemplary embodiment, the run scenario is the preferred method of dealing with armed intruder 301, but only if the occupant will not be in the field of fire or vision of attacker 301. In the case of a natural disaster or other building emergency, leaving the building may be best when it is safer than staying in the building, such as in the scenario when a fire exists or dangerous chemicals have been spilled. In accordance with an exemplary embodiment, the run images projected onto the floors of building 300 are the optimal paths for building occupants to most quickly and safely exit the building and escape any armed intruder within building 300.

If it is determined at step 202 that the run scenario is not preferred, server 100 determines (203) if this is a scenario where the hide scenario is preferred. If it is, server 100 performs (213) hide scenario processing. Hide scenario processing is described in more detail in FIG. 3B, but in general the hide scenario is chosen when occupants would be safer by hiding from attacker 301 than trying to run from attacker 301. In accordance with an exemplary embodiment, safe hiding areas are presented to building occupants via projected information, such as cross-hatched safety zones, to protect them from the dangerous effects of the phenomenon, such as the attacker or the natural disaster. In an exemplary embodiment, the hide scenario is the preferred method of dealing with armed intruder 301 when running is not considered safe. Hide scenario projections may be manually triggered, for example by using a physical button to capture user triggering intent in conjunction with sensor-derived, phenomenon-related context data and may include additional user input, such as added via voice.

If it is determined at step 203 that the hide scenario is not preferred, server 100 performs (214) fight scenario processing. Fight scenario processing is described in more detail in FIG. 3C, but in general the fight scenario is chosen as a last resort, when occupants only realistic option is to fight attacker 301. As one example, objects that can be used as improvised weapons are identified and located. These objects may include, for example, a fire extinguisher, a trophy, a baseball bat, a chair, or any other item that could be used as a weapon against another.

Figure 3A:
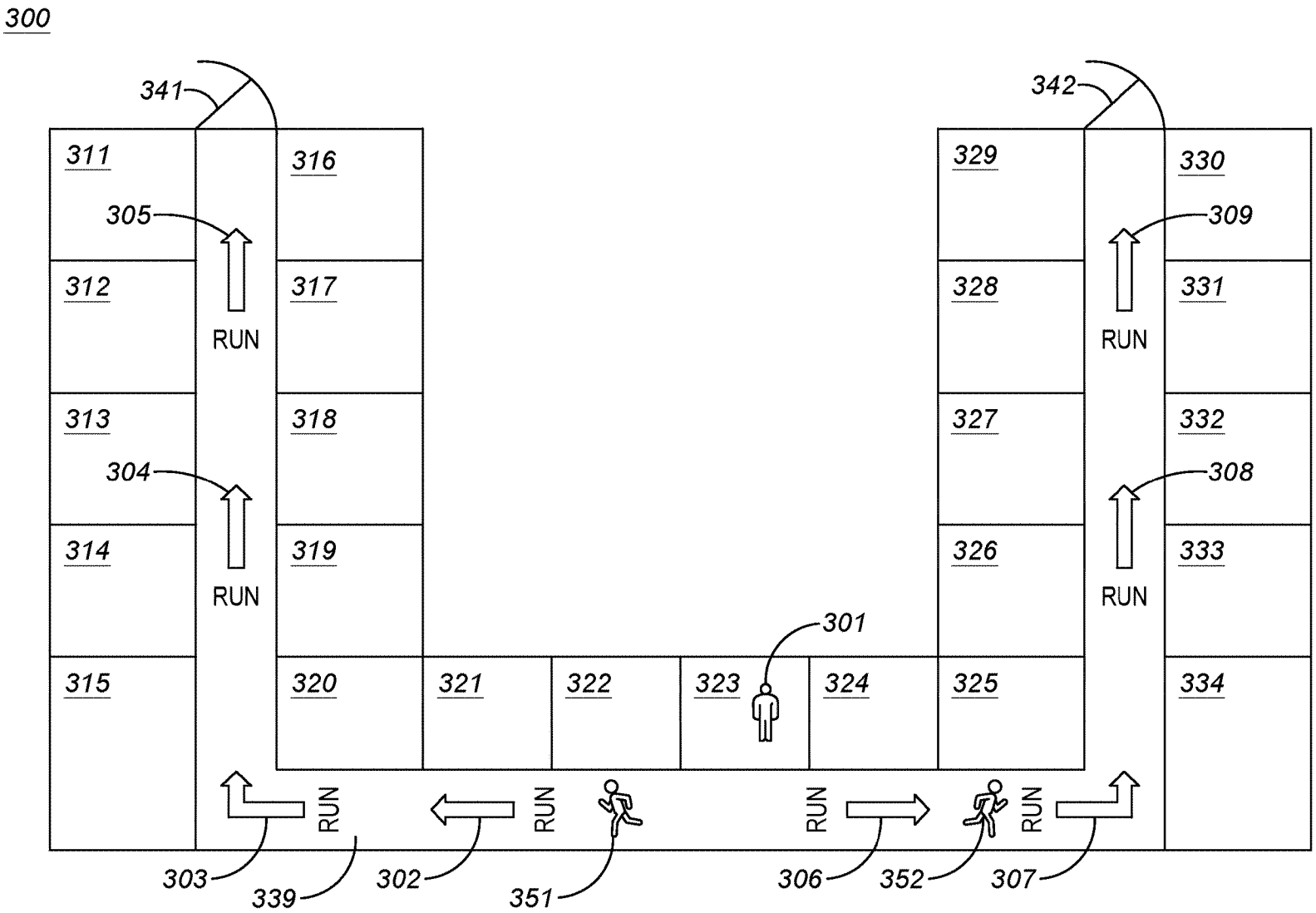
FIG. 3A depicts a schematic of a building during a run scenario in accordance with an exemplary embodiment.

FIG. 3A depicts a schematic of a building 300 during a run scenario. In accordance with an exemplary embodiment, building 300 is a school, but could alternately be any building, such as a shopping mall, an office building, a government building, or any other similar structure.

In the exemplary embodiment depicted in FIG. 3A, building 300 includes classrooms 311-334, hallway 339, doors 341 and 342, and a plurality of cameras and projectors, not shown, for example on the ceiling of hallway 339. It should be understood that building 300 would also include additional elements, but this simplified diagram shows the necessary elements of this exemplary embodiment and provides enhanced clarity.

Classrooms 311-334 depict classrooms for instructional use in a school setting. Classrooms 311-334 can alternately be offices in an office building or stores in a mall or other shopping center. Each classroom preferably has a door that leads into hallway 339. Classrooms 311-334 may also have one or more windows therein, or may be windowless.

In accordance with an exemplary embodiment, hallway 339 connects each of classroom 311-334 and also starts and ends at a door, such as doors 341 and 342.

Building 300 includes a plurality of cameras and projectors. Each projector can be integrated into a surveillance video camera or may be a separate device. In accordance with an exemplary embodiment, a projector or plurality of projectors assists building occupants to navigate themselves through building 300 in an emergency incident by projecting different signs and directional information on building surfaces.

In accordance with an exemplary embodiment, the projector comprises a projection or indication technology. The projector may include, for example, the following technologies, such as laser projection, digital light projection, servo-directed laser beam elements, laser diffraction grating, selective in-building illumination, or other suitable technology. The projector preferably delineates areas and rendering information to enable the use cases described herein.

In accordance with an exemplary embodiment, server 100 determines that the best course of action for at least some building occupants is to run. In accordance with an exemplary embodiment, server 100 knows the location of all building occupants. In the exemplary embodiment depicted in FIG. 3A, three people are depicted, attacker 301, occupant 351, and occupant 352. It should be understood that building 300 would typically include more occupants, but only two are depicted for clarity. In this exemplary embodiment, both occupant 351 and occupant 352 are best suited to run from attacker 301, because they are both outside of the field of view of attacker 301.

In the exemplary embodiment depicted in FIG. 3A, projectors assist building occupants in navigating themselves through building 300 during an emergency incident. This is accomplished in this "run" scenario by projecting different images onto floor 339 to direct the building occupants to the closest and safest place of escape from building 300. The images may be different for different building occupants. In the exemplary embodiment depicted in FIG. 3A, occupant 351 is directed to run toward door 341 via projections 302-305 and occupant 352 is directed toward door 342 via signs 306-309. As shown in FIG. 3A, signs 302-309 can include multiple elements, such as arrows indicating a direction to move, words indicating the action to take, and any other symbol that can assist building occupants in knowing the best action to take and where and how to move.

The decision on whether to instruct occupants to run, hide, or fight preferably takes into account the potential movement and FoV of the attacker is computed based on monitored movement behavior. If an occupant or occupants, such as a group of students, can be evacuated before an attacker is expected to see or reach them, an evacuation pathway is projected for them to follow.

In the exemplary embodiment depicted in FIG. 3A, server 100 calculates that it will take approximately thirty seconds for attacker 339 to get into hallway 339. Based on this calculation, server 100 determines that occupants 351 and 352 can evacuated from building 300 because, while they will be in hallway 339 at the five second mark, they will have left hallway 339 and exited building 300 before attacker 323 reaches hallway 339.

In this exemplary embodiment, attacker 301 is located in classroom 323. An emergency situation notification is received alerting personnel and servers that a dangerous person is in building 300. The emergency situation notification is preferably received from an electronic sensor, but can also be relayed from a human observer.

Doors 341 and 342 are preferably exit doors that lead out of building 300.

Figure 3B:
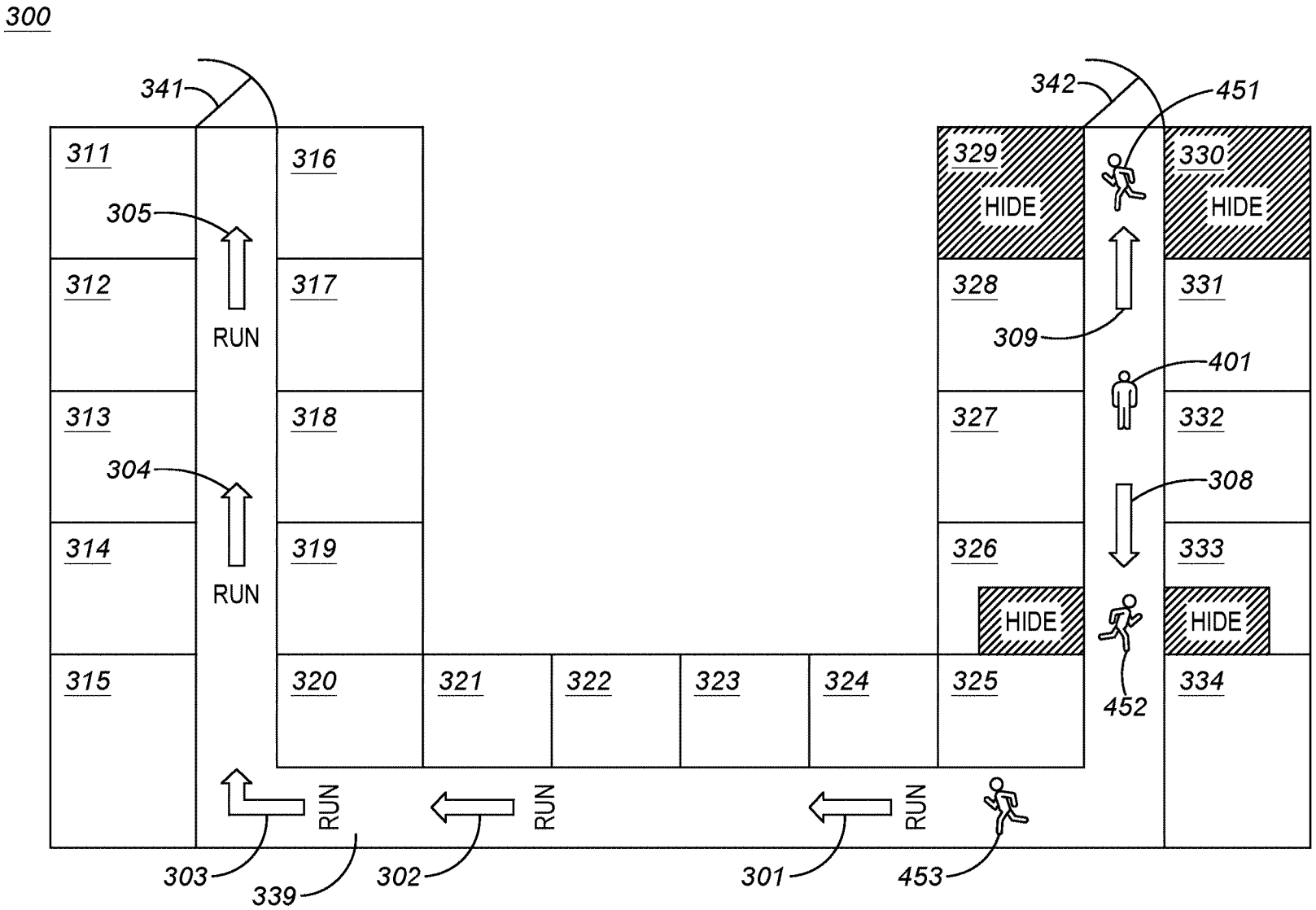
FIG. 3B depicts a schematic of a building during a hide scenario in accordance with an exemplary embodiment.

FIG. 3B depicts a schematic of building 300 during a hide scenario in accordance with an exemplary embodiment. In accordance with an exemplary embodiment, building 300 is a school, but could alternately be any building, such as a shopping mall, an office building, a government building, or any other similar structure.

In the exemplary embodiment depicted in FIG. 3B, building 300 includes classrooms 311-334, hallway 339, doors 341 and 342, and a plurality of cameras and projectors, not shown, for example on the ceiling of hallway 339. It should be understood that building 300 would also include additional elements, but this simplified diagram shows the necessary elements of this exemplary embodiment and provides enhanced clarity.

Classrooms 311-334 depict classrooms for instructional use in a school setting. Classrooms 311-334 can alternately be offices in an office building or stores in a mall or other shopping center. Each classroom preferably has a door that leads into hallway 339. Classrooms 311-334 may also have one or more windows therein, or may be windowless.

In accordance with an exemplary embodiment, hallway 339 connects each of classroom 311-334 and also starts and ends at a door, such as doors 341 and 342.

Building 300 includes a plurality of cameras and projectors. Each projector can be integrated into a surveillance video camera or may be a separate device. In accordance with an exemplary embodiment, a projector or plurality of projectors assists building occupants to navigate themselves through building 300 in an emergency incident by projecting different signs and directional information on building surfaces. The cameras and projectors are preferably located within rooms 311-334.

In accordance with an exemplary embodiment, the projector comprises a projection or indication technology. The projector may include, for example, the following technologies, such as laser projection, digital light projection, servo-directed laser beam elements, laser diffraction plates, selective in-building illumination, or other suitable technology. The projector preferably delineates areas and rendering information to enable the use cases described herein.

In accordance with an exemplary embodiment, server 100 determines that the best course of action for at least some building occupants is to hide from attacker 401. In accordance with an exemplary embodiment, server 100 knows the location of all building occupants. In the exemplary embodiment depicted in FIG. 3B, four people are depicted, attacker 401, occupant 451, occupant 452, and occupant 453. It should be understood that building 300 would typically include more occupants, but only three are depicted for clarity. In this exemplary embodiment, both occupant 451 and occupant 452 are best suited to hide from attacker 401, because they are within the field of view of attacker 401. Because occupant 453 is outside of the vision and point of view of attacker 401, server 100 directs occupant 453 to run from attacker 401.

In the exemplary embodiment depicted in FIG. 3B, projectors assist building occupants in navigating themselves through building 300 during an emergency incident. This is accomplished in this "hide" scenario by projecting different images onto floor 339 to direct the building occupants to the closest and safest place to hide from attacker 401. The images may be different for different building occupants. In the exemplary embodiment depicted in FIG. 3B, occupant 451 is directed to move toward room 329 or room 330 and hide therein. Occupant 452 is directed to move toward room 326 or room 333 and hide therein. Occupant 453 is directed to run toward door 341 via projections 301-305. As shown in FIG. 3B, signs 302-309 can include multiple elements, such as arrows indicating a direction to move, words indicating the action to take, and any other symbol that can assist building occupants in knowing the best action to take and where and how to move.

The decision on whether to instruct occupants to run, hide, or fight preferably takes into account the potential movement and FoV of the attacker is computed based on monitored movement behavior. In the exemplary embodiment depicted in FIG. 3B, occupants 451 and 452 are best suited to hide from attacker 401, since they are within the field of view of attacker 401.

In the exemplary embodiment depicted in FIG. 3B, server 100 calculates that it will take approximately five seconds for attacker 339 to see occupant 451 or occupant 452, and that it would take more time for occupant 451 or 452 to get themselves out of the field of view of attacker 401. Therefore, server 100 determines that occupants 451 and 452 should hide from attacker 401. Occupant 452 is outside of the field of view of attacker 401, and therefore the best option for occupant 453 is to run from building 300. Server 100 instructs the projectors located within hallway 339 to project a run projection that leads occupant 453 along hallway 339 toward door 341.

In this exemplary embodiment, attacker 401 is located in hallway 339. An emergency situation notification is received alerting personnel and servers that a dangerous person is in building 300. The emergency situation notification is preferably received from an electronic sensor, but can also be relayed from a human observer.

Doors 341 and 342 are preferably exit doors that lead out of building 300.

A projector in room 326 projects a safe area that occupants can hide from the view of attacker 401 when attacker 401 is located in hallway 339 and not in room 326. By being out of the view of attacker 401, the occupants in the safe area are more secure than they would be if they were located within the field of view of attacker 401 when attacker 401 is in hallway 339 outside of room 326.

Processor 102 computes the potential movement and the field of view attacker 401 based on monitored movement behavior of attacker 401. If building occupants, such as a group of students, cannot be evacuated before attacker 401 is expected to see or reach them, an idealized shelter-in-place area is calculated and projected for the building occupants to hide in. This is preferably accomplished in 3D, so that the most detailed information can be presented to the building occupants. For example, the area within the FoV cone geometry that is occluded, such as by architectural features or furniture, can be projected. The area preferably reflects an internally offset distance as a safety factor.

Within the safe shelter-in-place zone, server 100 may recommend individual placement. For example, building occupants may be densely huddled to reduce visibility, or may be distributed to increase shooter difficulty. In accordance with an exemplary embodiment, server 100 recommends the individual placement of occupants Within the safe shelter-in-place zone. In accordance with a first exemplary embodiment, server 100 recommends individual placement of occupants, for example having occupants densely huddled together to reduce visibility to attacker 401. In a further exemplary embodiment, server 100 recommends distributed placement of occupants to increase shooter difficulty for attacker 401.

In accordance with an exemplary embodiment, the calculation frequency is increased corresponding to a decreasing distance between attacker 401 and building occupants. In this exemplary embodiment, the closer attacker 401 is to the building occupants, the more precise the recommendations from server 100 become.

In the exemplary embodiment, depicted in FIG. 3B, attacker 401 is in 339 hallway, and occupants 451-452 are also in hallway 339. In accordance with an exemplary embodiment, server 100 determines likely and potential paths for attacker 401 and calculates the FOV of attacker 401 at points along the likely and potential paths. The combined calculation of occluded FOV yields a safe area which is projected on the floor and walls.

Potential movement and FoV of attacker 401 is computed based on monitored movement behavior of attacker 401. If a group of building occupants, such as students, cannot be evacuated before an attacker is expected to see or reach them, an idealized shelter-in-place area is calculated and projected for the occupants to hide in. The area preferably reflects an internally offset distance as a safety factor.

In accordance with an exemplary embodiment, if a 3D model of building 300 is not available, server 100 can identify potential hiding areas utilizing shadow analysis, which involves building a database during a non-emergency, moving a bright light around within a building as a way to find dark shapes. In accordance with a further exemplary embodiment, server 100 can identify potential hiding areas utilizing multi-camera and projector cooperative scanning, in which one camera can see the projection from another projector. If different camera and projector locations have different colors or patterns, a view map can be built.

In accordance with an exemplary embodiment, if the FOV of two cameras is known, an object or person seen moving from one camera to an adjacent camera can provide a video view vector intersection. In this scenario, server 100 can determine that attacker 401 is in that location and looking at different views of a common or adjacent area.

In a further exemplary embodiment, borders of shapes could include some representation of uncertainty. For example, edges of some objects could be fuzzy or imprecise. If uncertainty calculations establish bounds, the lowest bound is used as a dimensional threshold, the smallest, and likely safest hiding shape, is calculated because it would be hardest for an attacker to see.

In the case of natural disasters or the like, areas of imminent building and physical environment collapse could be detected using seismic or structural integrity sensors. Once these unsafe areas are detected, occupants could be directed to safe areas, such as shelter in structurally sound areas of building 300. During a severe weather condition, such as a tornado or hurricane, occupants can be directed to safe areas to minimize their chances of being struck by windborne debris. Safe areas could be identified based on their structural properties, such as building elements and materials like wall and window types, along with risky objects in the environment like trees and hazard-related information like wind direction and speed. In the scenario where there is a sudden release of dangerous gasses or liquids, detection occurs and building occupants are directed to safe areas, such as watertight or airtight areas with additional reinforcement to resist pressure and explosions, or well ventilated areas to provide people with access to safer air. Further, if the density of the dangerous chemical released is heavier or lighter than air, people could be directed to stand or crawl to minimize the impact of exposure.

Figure 3C:
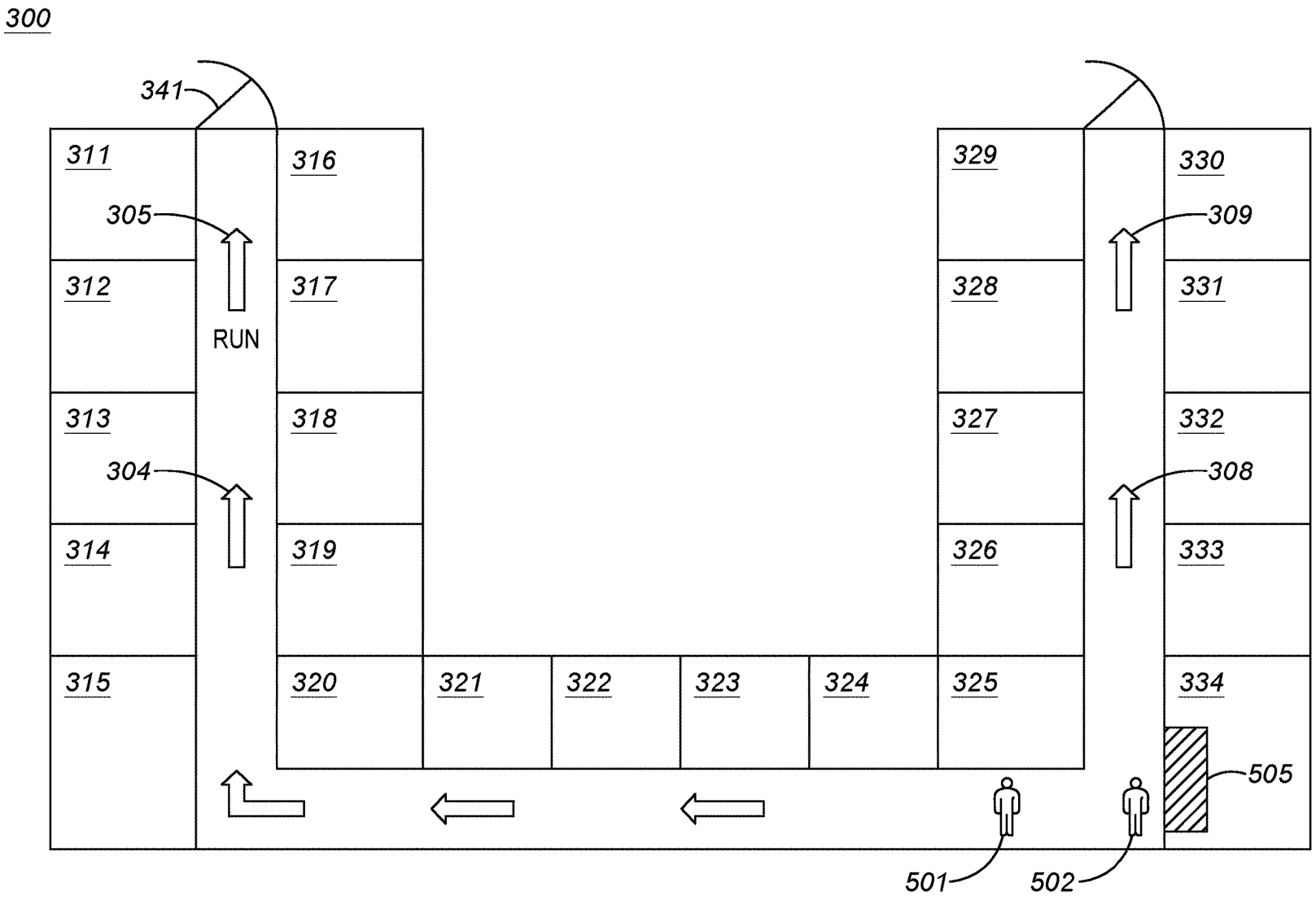
FIG. 3C depicts a schematic of a building during a fight scenario in accordance with an exemplary embodiment.

FIG. 3C depicts a schematic of building 300 during a fight scenario in accordance with an exemplary embodiment. Building 300 includes trophy case 505, but in other respects is configured in the same way as in FIGS. 3A and 3B. As in the earlier embodiments, the projectors can be integrated into the video cameras or can be separate devices.

In this exemplary embodiment, occupant 502 is cornered by attacker 501. Server 100 determines that it is not safe for occupant 502 to run from attacker 501. In addition, server 100 determines that occupant 502 would not be safe to hide, in this exemplary embodiment because occupant 502 is within the view of attacker 501. Therefore, server 100 determines that the best course of action for occupant 502 is to fight attacker 501.

In this exemplary embodiment, server 100 performs fight scenario processing. Server 100 determines if there are any objects in the near environment of occupant 502 that make suitable improvised weapons. In accordance with an exemplary embodiment, objects are pre-identified as part of an emergency action plan. In an alternate exemplary embodiment, objects are identified via object identification and selection using an improvised weapons database.

In accordance with an exemplary embodiment, a projector located near trophy case 505 projects images onto trophy case 505. The images can include object highlighting and supplemental text. The object highlighting can be, for example, a line outlining an object that could be used as a weapon against attacker 501. The supplemental text can include illustration-based explanations for how to use the object in trophy case 505 as a weapon. Trophy case 505 is depicted in more details in FIG. 4 below.

In this manner, in the scenario where the best option for occupant 502 is to fight attacker 501, server 100 will utilize one or more projectors to project images onto local items that can be used as improvised weapons against attacker 501 and provide the best chance for occupant 502 to escape from the emergency situation that occupant 502 finds himself or herself in.

Figure 4:
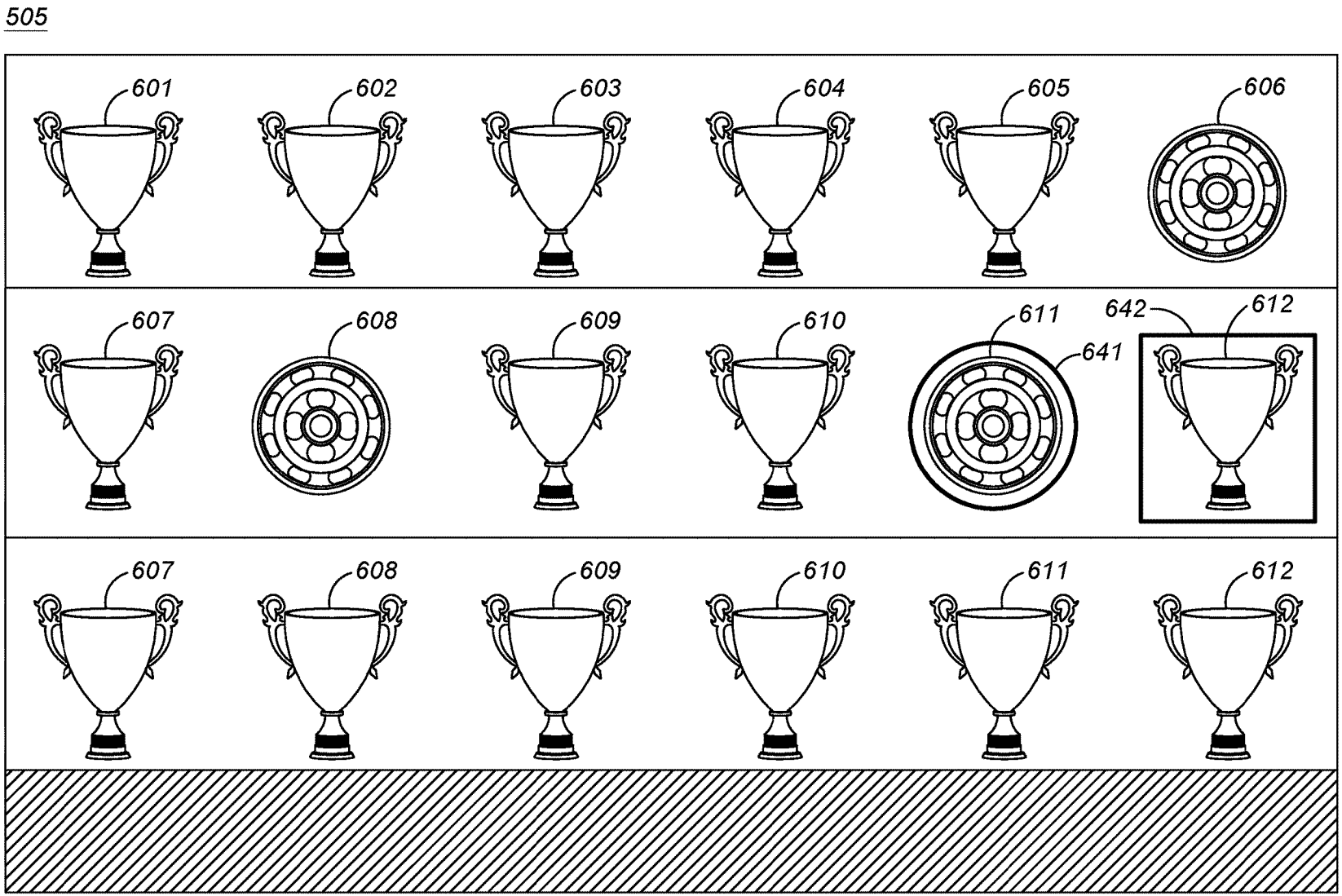
FIG. 4 depicts a trophy case including items to potentially be used as weapons in accordance with an exemplary embodiment.

FIG. 4 depicts a trophy case 505 including items to potentially be used as weapons in accordance with an exemplary embodiment.

In accordance with an exemplary embodiment, trophy case 505 includes a plurality of trophies 601-618. Trophies 601-618 may be similar or very different from one another. Server 100 determines which items near occupant 502 could make a suitable weapon. As mentioned earlier, this can be done by adding items to a weapons database, in which each weapon record would preferably include a name of the weapon, the size and shape of the weapon, an outline of the weapon, and the location of the weapon within building 300. Server 100 instructs a nearby projector to highlight objects near occupant 502 that could be used as weapons and the projector outlines or highlights those weapons so that occupant 502 can readily use them in this emergency situation. As an example, in FIG. 4, a projector has highlighted two trophies that could be used as improvised weapons, trophy plate 611 and trophy 612. The projector has highlighted trophy 611 with highlight 641 and has highlighted trophy 612 with highlight 642. Server 100 may decide to limit the number of items highlighted so as to not overload a building occupant already in a stressful situation. The number of improvised weapons highlighted may be impacted by the number of building occupants located in the area. It should be understood that the improvised weapons selected may include other trophies or other nearby items, such as fire extinguishers, chairs, tables, books, or anything that could be used to defend occupant 502 from attacker 501.

In accordance with an exemplary embodiment, the projector also projects words or symbols that assist occupant 502 in identifying or using the improvised weapon. For example, the word "grab" or "weapon" could be projected on trophy case 600, as well as words in multiple languages or icons that are universally recognized. A visual symbol, such as a person striking another person with a plate could also be projected onto trophy case 600 or a nearby surface to show occupant 502 how to use an improvised weapon.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element preceded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized electronic processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising an electronic processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A method to project a safe area during an emergency situation, the method comprising:

determining, using at least one electronic sensor, that an emergency situation is occurring in a building;

determining likely unsafe areas within the building during the emergency situation;

determining a likely safe area within the building during the emergency situation, the likely safe area being distinct from the likely unsafe areas, wherein the step of determining a likely safe area within the building comprises determining the likely safe area utilizing a safe hiding area geometry, wherein the safe hiding area geometry comprises an occluded area in the building; and projecting, utilizing an electronic projector, visual guidance features within the building, the visual guidance features directing occupants in the building toward the likely safe area.

2. The method of claim 1, wherein the step of determining that an emergency situation is occurring comprises determining that there is an attacker within the building.

3. The method of claim 2, wherein the step of determining that there is an attacker within the building comprises determining a direction of movement of the attacker.

4. The method of claim 2, the method further comprising the step of determining a field of view of the attacker.

5. The method of claim 1, wherein the step of determining that an emergency situation is occurring comprises determining that the emergency situation is a natural disaster moving toward the building.

6. The method of claim 1, wherein the step of determining that an emergency situation is occurring comprises determining that the emergency situation is a chemical spill or chemical leak.

7. The method of claim 1, wherein the step of determining a likely safe area within the building comprises taking into account building materials that the building is constructed of.

8. The method of claim 1, wherein the safe hiding area geometry comprises safety factor offsets.

9. The method of claim 1, wherein the step of determining a likely safe area within the building comprises determining a safest person distribution in the safe hiding area geometry.

10. The method of claim 1, the method further comprising the step of updating the visual guidance features.

11. The method of claim 1, wherein the visual guidance features comprise text.

12. The method of claim 1, wherein the visual guidance features comprise directional arrows.

13. The method of claim 1, the method further comprising the step of projecting highlights on objects that can be used as improvised weapons within the building.

14. The method of claim 13, wherein the step of projecting highlights on objects that can be used as improvised weapons within the building comprises projecting images of improvised weapons using real-time object recognition.

15. The method of claim 1, wherein the step of projecting visual guidance features within the building comprises projecting visual guidance that leads toward the likely safe area.

16. The method of claim 1, the method further comprising the step of projecting highlights on objects that can be used as barricades.

17. A server comprising:

a processor for:

determining, using at least one electronic sensor, that an emergency situation is occurring in a building;

determining likely unsafe areas within the building during the emergency situation; and determining a likely safe area within the building during the emergency situation, the likely safe area being distinct from the likely unsafe areas, wherein the step of determining a likely safe area within the building comprises determining the likely safe area utilizing a safe hiding area geometry, wherein the safe hiding area geometry comprises an occluded area in the building; and an output port for sending a signal to an electronic projector to instruct the projector to project visual guidance features within the building, the visual guidance features directing occupants in the building toward the likely safe area.

18. The server of claim 17, wherein the emergency situation comprises an attacker within the building.

* * * * *